US009689150B2

(12) United States Patent
Nelson

(10) Patent No.: US 9,689,150 B2
(45) Date of Patent: Jun. 27, 2017

(54) PORTABLE WASHING STATION

(71) Applicant: Charles R. Nelson, La Pointe, WI (US)

(72) Inventor: Charles R. Nelson, La Pointe, WI (US)

( * ) Notice: Subject to any disclaimer, the term of this patent is extended or adjusted under 35 U.S.C. 154(b) by 655 days.

(21) Appl. No.: 13/854,881

(22) Filed: Apr. 1, 2013

(65) Prior Publication Data

US 2013/0254986 A1 Oct. 3, 2013

Related U.S. Application Data

(60) Provisional application No. 61/686,294, filed on Apr. 2, 2012.

(51) Int. Cl.
*E03C 1/322* (2006.01)
*E03C 1/18* (2006.01)
*A47K 3/28* (2006.01)

(52) U.S. Cl.
CPC ..... *E03C 1/18* (2013.01); *A47K 3/285* (2013.01)

(58) Field of Classification Search
CPC ..... A45C 13/30; A45C 13/42; A45C 15/04; A45C 2013/1015; A45C 2200/15; A45C 5/005; A47K 1/02; A47K 1/05; A47K 1/12; E03C 1/18; E03C 1/32; E03C 1/322
USPC ..... 132/286–318; 190/12 R; 206/320, 470, 206/527, 542, 547, 576–577, 581, 823; 312/228–228.1, 327; 4/514, 516–517, 4/587, 619–661
See application file for complete search history.

(56) References Cited

U.S. PATENT DOCUMENTS

| | | | | |
|---|---|---|---|---|
| 602,994 A | | 4/1898 | Briggs | |
| 616,106 A | | 12/1898 | Houston | |
| 734,348 A | | 7/1903 | Muehl | |
| 1,783,712 A | * | 12/1930 | Hernandez | A47K 1/02 211/1 |
| 3,251,637 A | * | 5/1966 | Parsons, Jr. | A47K 1/02 190/12 R |
| 3,324,483 A | * | 6/1967 | Conroy | E03C 1/18 248/146 |
| 3,915,529 A | * | 10/1975 | Bernier | A47B 3/10 126/37 B |
| 6,161,228 A | * | 12/2000 | Wietecha | A47K 1/02 4/625 |
| 6,293,328 B1 | * | 9/2001 | Fremont | E04B 2/7427 160/135 |

(Continued)

*Primary Examiner* — Allana Lewin Bidder
*Assistant Examiner* — Nicholas Ros
(74) *Attorney, Agent, or Firm* — Richard C. Liman

(57) ABSTRACT

The portable washing station has a mounting plate having rigid upper and lower sections joined by fabric so that it can be folded up for storage and transport. The washing station has a detachable sink basin attached to the lower section, made of flexible and lightweight, waterproof material. The washing station has straps that serve a dual purpose. While in use, the straps allow the washing station to be mounted to a support structure, such as a tree, utility pole, sailboat mast, fence post or any other structure of sufficient height. The straps also keep the portable washing station securely in the stored configuration, when folded up. This portable washing station is perfect for families while camping, the military while cleaning weapons in the field, first responders during natural disasters and any other users in which the convenience of providing and maintaining good hygiene are necessary.

16 Claims, 7 Drawing Sheets

(56) References Cited

U.S. PATENT DOCUMENTS

| | | | | |
|---|---|---|---|---|
| 6,546,569 | B2 * | 4/2003 | Figueras | A47K 13/005 4/460 |
| 6,554,001 | B1 * | 4/2003 | Godshaw | A45D 42/04 132/312 |
| 6,959,460 | B2 | 11/2005 | Patterson | |
| 2008/0141452 | A1 * | 6/2008 | Karbowski | A47K 3/127 4/572.1 |
| 2008/0289925 | A1 * | 11/2008 | Sapyta | A45C 7/0054 190/109 |
| 2010/0013211 | A1 * | 1/2010 | Ahmed | A45C 13/42 283/80 |

* cited by examiner

PORTABLE WASHING STATION

CROSS-REFERENCE TO RELATED APPLICATION

This application claims the benefit of U.S. Provisional Patent Application Ser. No. 61/686,294, filed Apr. 2, 2012; the disclosures of which are hereby incorporated by reference in their entirety.

BACKGROUND OF THE INVENTION

1. Field of the Invention

The present invention generally relates to a travel hygiene device, and more particularly, to a portable washing station for oral hygiene, personal cleanliness and medical treatment.

2. Description of the Related Art

Portable washing equipment is desirable for use in recreational, emergency and temporary service applications, especially when camping. While recreational vehicles and campers are fitted with sinks and pumps for supplying fresh water for washing, campers with tents do not have such plumbing facilities and must rely on the provision of such washing facilities at recognized campsites. When camping in remote areas, park facilities often provide toilets, but neglect to offer washing facilities with running water. To shave and wash in a park facility often occupies the washroom for an extended period. However, in wilderness regions and remote camping grounds, such washrooms are often not provided.

Along the same lines, military personal stationed in the field do not always have the facilities necessary to clean their equipment, or themselves, without the modern conveniences of indoor plumbing. Relief aid workers working in remote corners of the world need the amenities provided by a sanitary bathroom in order to provide medical treatment to those in need. Hurricanes, floods, tornadoes and other natural disasters force people from their homes for extended periods.

Thus, a portable washing station solving the aforementioned problems is desired.

SUMMARY OF THE INVENTION

The portable washing station includes a mounting plate having an upper section and a lower section so that it can be folded up into a stored configuration, capable for travel. The washing station has a detachable sink basin, which is attached to the lower section. The basin is made of flexible, lightweight, waterproof material, which is also chemical-resistant. The entire washing station has straps that serve a dual purpose. The straps allow the washing station to be mounted to a support structure, such as a tree, utility pole, sailboat mast, fence post, or any other structure of sufficient height for use. The straps also keep the portable washing station securely in the stored configuration, when the station is folded up.

This portable washing station is perfect for families while camping, the military while cleaning weapons in the field, first responders during natural disasters and any other users in which the convenience of providing and maintaining good hygiene is necessary.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
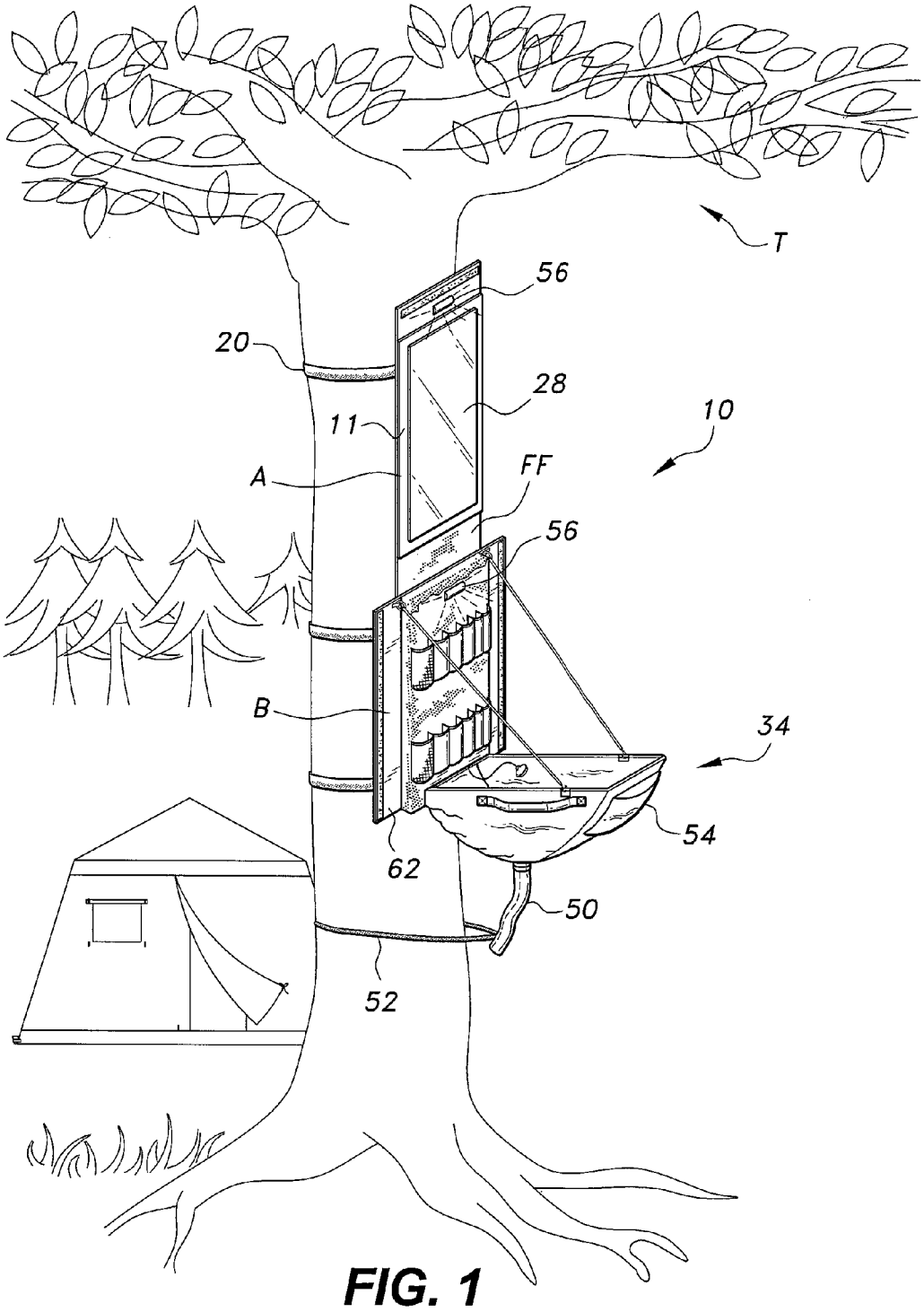
FIG. 1 is an environmental perspective view of a portable washing station according to the present invention, shown fully deployed for use.
Figure 3:
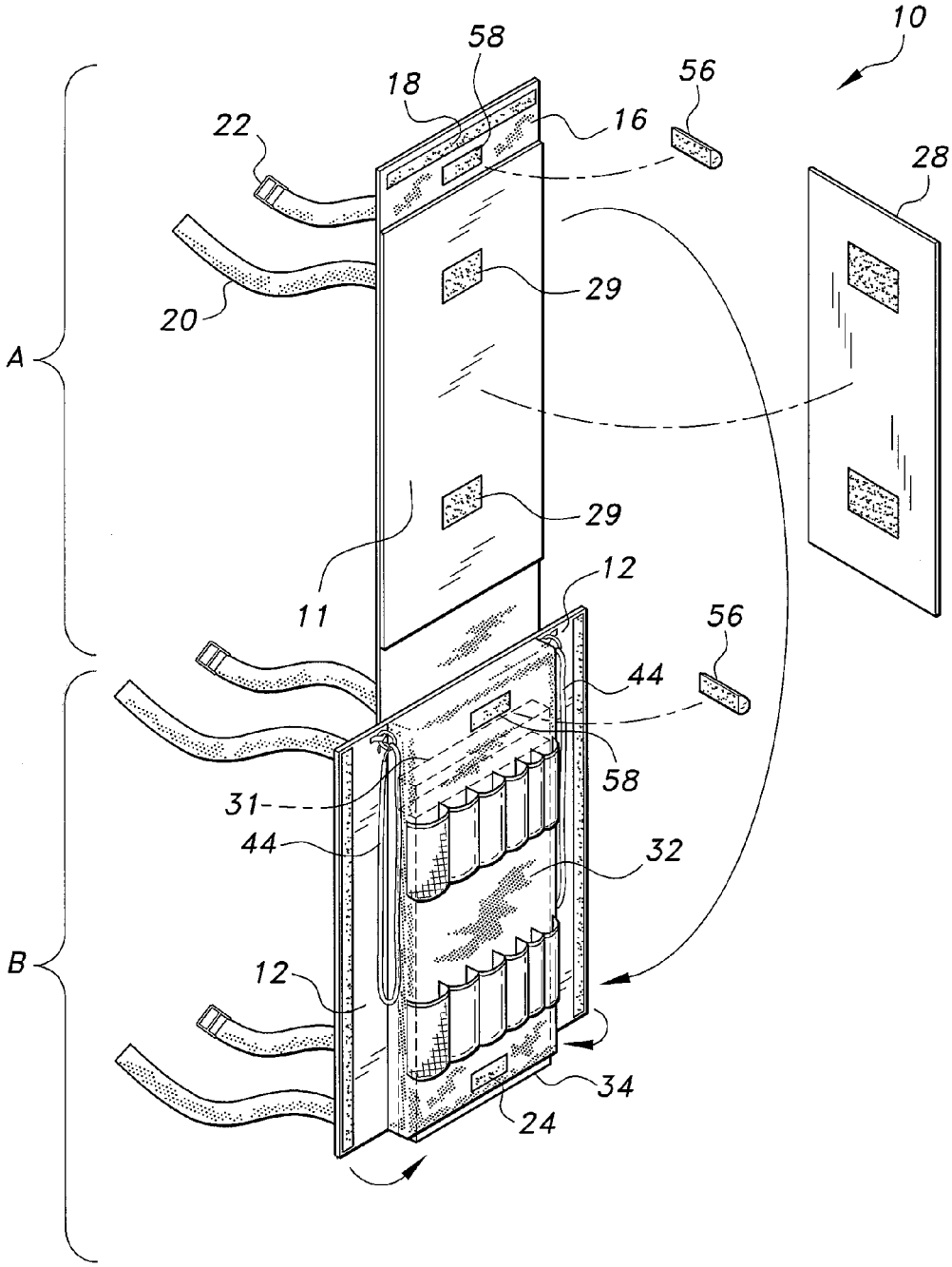
FIG. 3 is a perspective view of the portable washing station of FIG. 1, shown with the sink removed and packed away, the mirror being exploded away from the upper section.

As shown in FIG. 1, the portable washing station 10 has mounting plates 11 and 12, which is capable of being folded into a stored configuration for travel. The washing station 10 is perfect for families while camping, for the military while cleaning weapons in the field, for first responders during natural disasters, and for any other users in which the convenience of providing and maintaining good hygiene is necessary. The washing station 10 is designed to fold into a small size for storage and transport. When in use, the station 10 unfolds into two main sections, an upper section A and lower section B that are pivotally attached to each other by flexible fabric FF. The basin 34 is pulled out of a storage pocket 32 in the lower section B, as shown in FIG. 3. The washing station 10 is designed to fit inside a bag that meets federal regulations for commercial aircraft carry-on luggage dimensions. of providing and maintaining good hygiene is necessary. The washing station 10 is designed to fold into a small size for storage and transport. When in use, the station 10 unfolds into two main sections, an upper section A and lower section B that are pivotally attached to each other by flexible fabric. The basin 34 is pulled out of a storage pocket 32 in the lower section B. The washing station 10 is designed to fit inside a bag that meets federal regulations for commercial aircraft carry-on luggage dimensions.

When in the open configuration for use, the washing station 10 can be secured to a support structure, such as a nearby tree T, with straps 20 having fasteners 22, the straps 20 being attached directly to the mounting plates 11 and 12. Optional hooks (not shown) can also be placed at the top of the upper section A so that the washing station 10 may be suspended from a support if the user chooses not to strap the washing station 10 to the support structure T. When the outer side 60 of the mounting plate 11 is strapped to the tree T, the inner face 62 of mounting plates 11 and 12 facing towards the user, as seen in FIG. 1. The mounting plate has two distinct functional areas, an upper section A and a lower section B.

Figure 2:
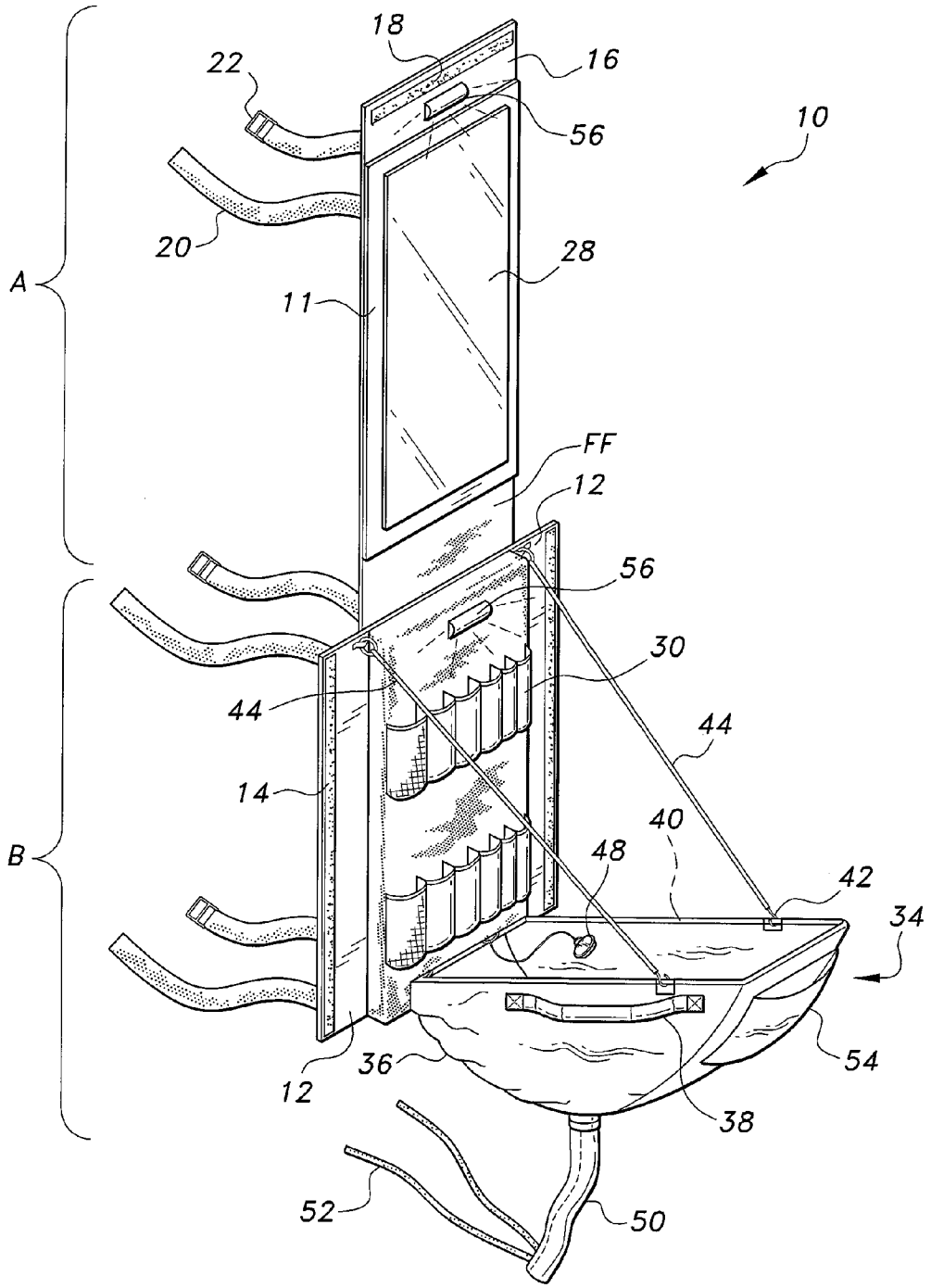
FIG. 2 is a perspective view of the portable washing station of FIG. 1.

Referring to FIG. 2, the upper section A has a mirror 28 illuminated by a light 56. The mirror 28 is made from a flexible, shatterproof material. For ease of use when removing and cleaning, the mirror 28 is affixed to mounting plate 11 with strips of hook and loop fasteners 29, as depicted in FIG. 3. Above the mirror 28, the light 56 is also secured with hook and loop fasteners 58. There is an optional location for the light 56 to be placed on the lower section B with fasteners 58 as well.

Figure 4:
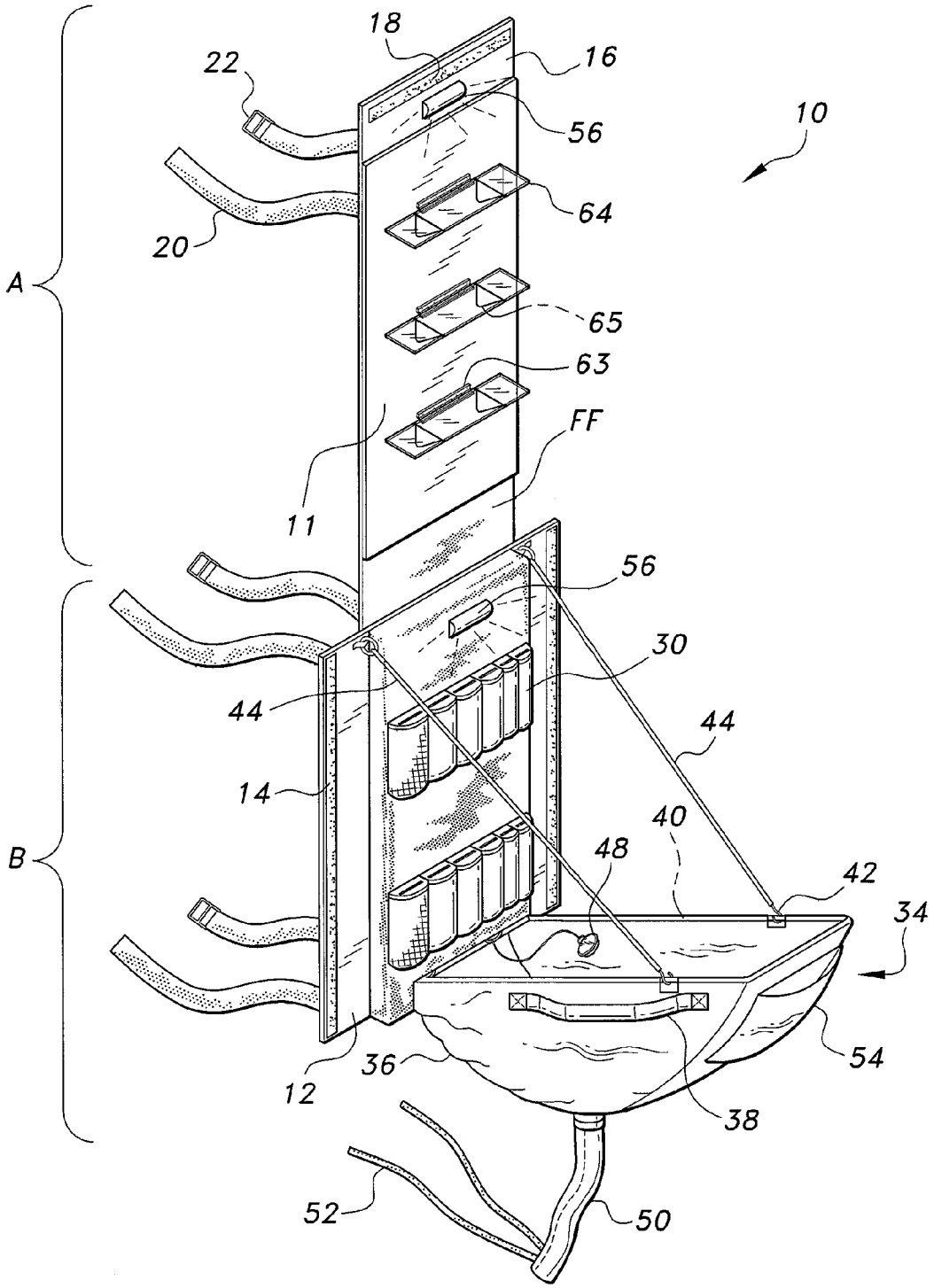
FIG. 4 is a perspective view of an alternative embodiment of a portable washing station according to the present invention.
Figure 5:
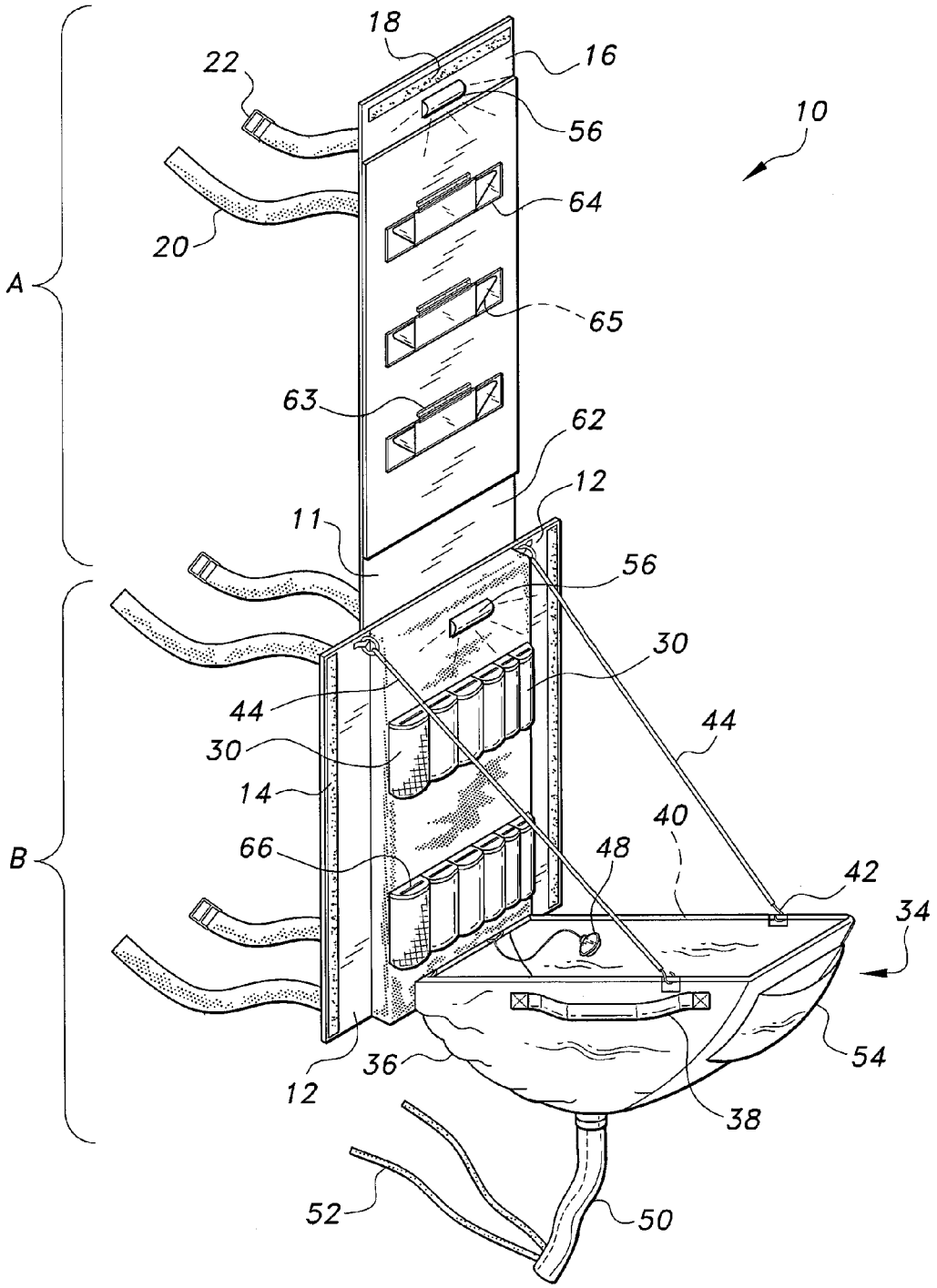
FIG. 5 is a partial perspective side view of the portable washing station of FIG. 4, shown with the shelves pivoted for storage.

FIG. 4 shows another embodiment in which the mirror 28 may be replaced with three folding shelves 64 that have hinges 63 attached to the mounting plate 11. When in place, the shelves 64 have gussets 65 that can be locked into place and then released in order for them to lay flat so that the washing station 10 may be folded up, as shown in FIG. 5.

Figure 7:
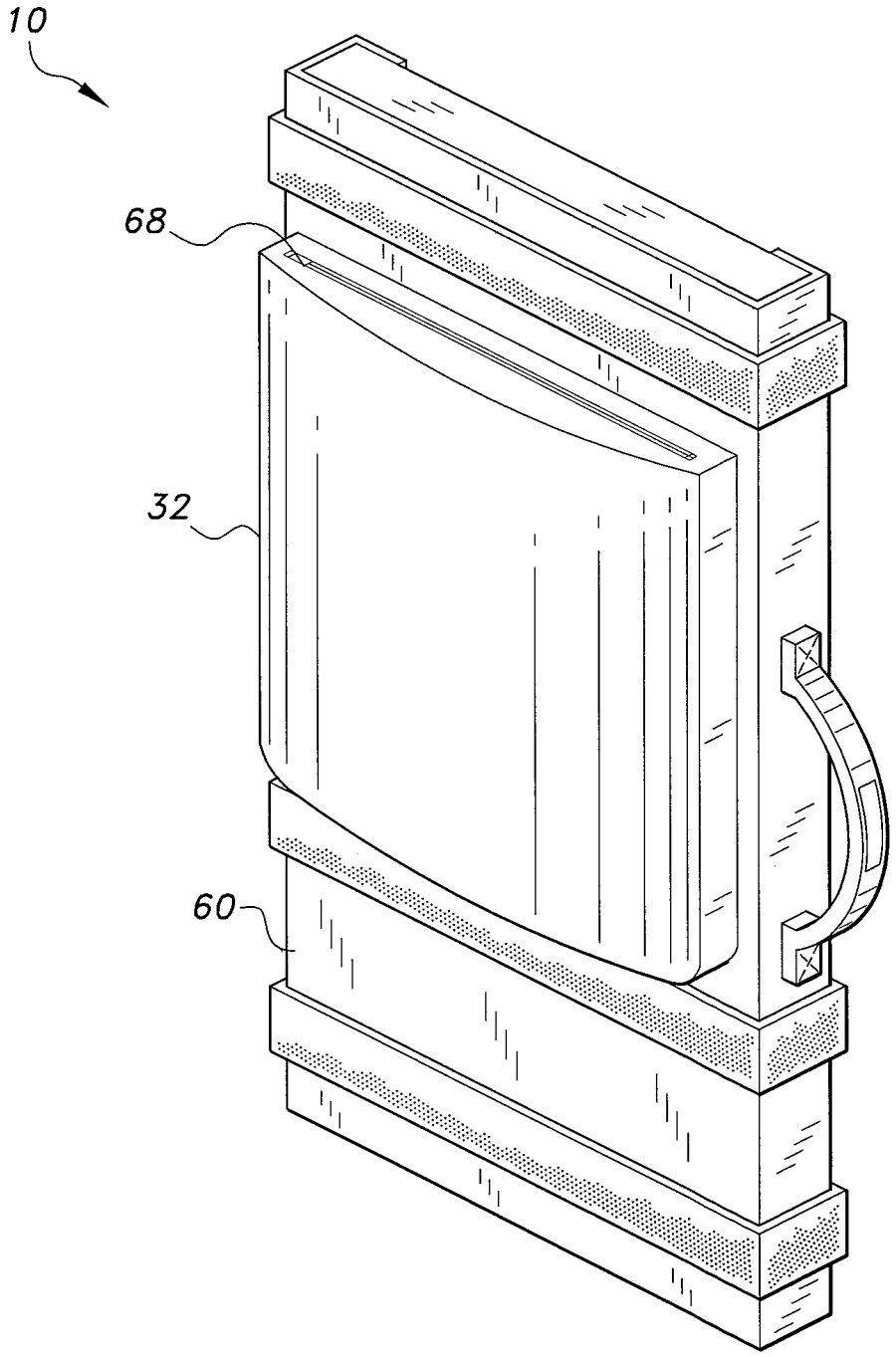
FIG. 7 is a perspective view of the portable washing station of FIG. 6, showing the opposite back face of the station when configured for storage or transport.

Since this washing station 10 will be used primarily for personal hygiene, small storage pockets 30 are provided for holding items, such as soap, toothbrush, toothpaste, deodorant (or any other toiletry item), but it need not be limited to these items. When the washing station 10 is used for meal preparation, the storage pockets 30 could be used to store cooking utensils, silverware, spices, sponges, etc. The first embodiment shows pockets 30 that are open. However, the alternative embodiment, as shown in FIG. 5, shows storage pockets 30 that each have a zipper 66 for releasably closing the pockets 30 and securing the contents inside. Hook and loop fasteners, buttons or magnets could also be substituted for the zipper 66 to securely close the storage pockets 30. The pockets 30 may be made out of a solid fabric or a mesh material. FIG. 7 shows another alternative embodiment that has an external storage pocket 32, located on the outer face 60 of the lower section B.

Another feature of the washing station 10 is the flexible sink basin 34 that is attached to the lower section B by way of hook and loop fasteners 24 (shown in FIG. 3) and a pair of suspension cables 44 having hooks 42 attached to the steel rod frame 40 of the basin 34. When not in use, the straps 44 can be attached to the mounting plate 12 by the hooks 42. The basin 34 is made from a lightweight and flexible, waterproof canvas fabric 36 that will also hold up to chemicals compounds, such as disinfectants used to clean the wash station 10 or materials used to clean weapons. On the side of the basin 34 is a towel bar or strap 38 for supporting a towel. This design is not limited to the number of attachments shown or fabric used.

When attached, the basin 34 is perpendicular to the mounting plate 12 in a manner such that any fluid held in the basin 34 would drain down out through the drain hose 50. If a user wanted to trap water in the basin 34, a drain plug 48 would simply be inserted into the drain until such time that the fluid is to be drained from the basin 34. In order to control where the fluid is drained and to prevent undesired splashing of the fluid when draining, drain straps 52 are used to tie back the drain hose 50 to the support structure T. When the washing station 10 is packed up into its stored configuration, the drain hose 50 is stored in a storage pocket 54 located on the front of the basin 34.

Figure 6:
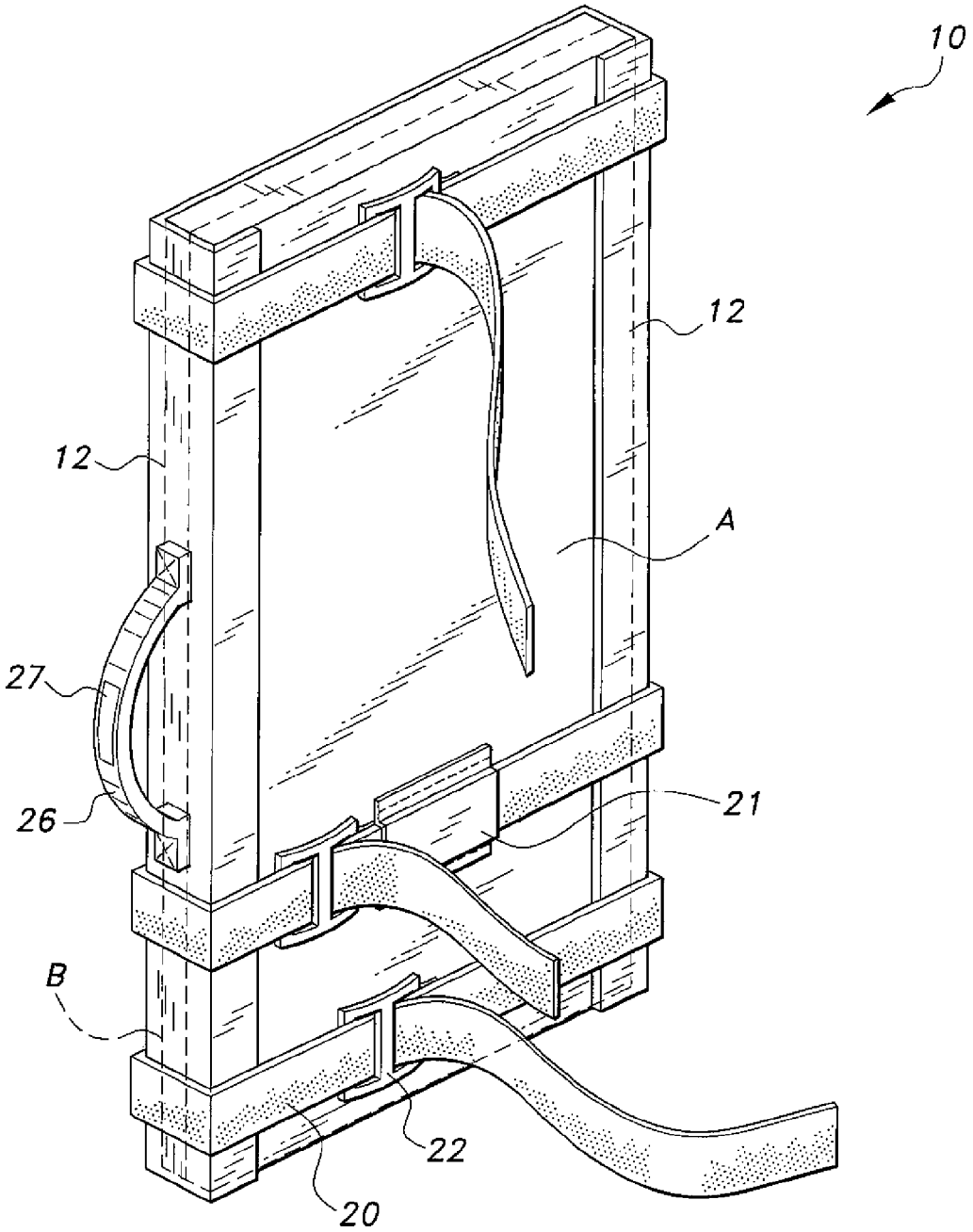
FIG. 6 is a perspective view of the portable washing station according to the present invention, shown packed away for storage and transport.

In order to fold up the washing station 10, as shown in FIG. 6, the basin 34 is removed. The basin 34 is slid up into a large storage pocket 32 (as shown in FIG. 7) and closed by zipper 68. The upper section A is folded down towards the lower section B. At such time, a bottom flap 16 is folded over and secured with hook and loop fastener 18. Then the pair of side flaps 12 are folded over and secured by hook and loop fasteners 14.

Once all the flaps are folded, straps 20 are fastened with fasteners 22, holding the basin 34 securely in place as well. An additional strap buckle 21 is placed on the middle strap 20 to assure that the straps are secure. The outer side 60 of the side flap 12 has a carrying handle 26 and an identification tag 27.

Except for the rigid upper A and lower B sections of the mounting plates 11 and 12, respectively, substantially the entire washing station 10 is made from a lightweight and flexible, waterproof canvas fabric 36 and may be made in a variety of colors in order to designate its intended use. For example, green may be chosen for camping, red for first aid, blue for washing, orange for cooking, and so on.

It is to be understood that the present invention is not limited to the embodiments described above, but encompasses any and all embodiments within the scope of the following claims.

I claim:

1. A portable washing station, comprising:

a mounting plate having a rigid upper section, a rigid lower section, and flexible fabric foldably attaching the upper section to the lower section;

a main storage pocket internal to the rigid lower section, the main storage pocket being made from flexible fabric, wherein the main storage pocket opens at the free end of the rigid lower section.

a flexible fabric basin releasably attached to the rigid lower section of the mounting plate, wherein the flexible fabric basin is detachable from the rigid lower section of the mounting plate and foldable for storage in the main storage pocket;

a pair of suspension cables attached to the mounting plate and releasably attachable to the basin, the cables support the basin substantially normal to the mounting plate;

means for draining fluids from the basin; and means for releasably securing the mounting plate to a support structure.

2. The portable washing station according to claim 1, wherein said means for releasably securing said mounting plate to the support structure comprises a plurality of straps having fasteners.

3. The portable washing station according to claim 1, further comprising a towel holder attached to said basin.

4. The portable washing station according to claim 1, wherein said basin comprises a steel rod frame and a flexible fabric body disposed on the frame.

5. The portable washing station according to claim 1, further comprising at least one light removably attached to said mounting plate.

6. The portable washing station according to claim 1, further comprising a mirror releasably attached to the upper section of said mounting plate.

7. The portable washing station according to claim 6, further comprising mating hook and loop fasteners attached to said mounting plate and to said mirror.

8. The portable washing station according to claim 1, further comprising at least one folding shelf pivotally attached to the upper section of said mounting plate, the at least one shelf being pivotal between a first position parallel to said mounting plate and a second position normal to said mounting plate.

9. The portable washing station according to claim 8, wherein said at least one folding shelf comprises three shelves.

10. The portable washing station according to claim 1, further comprising a plurality of secondary storage pockets attached to said mounting plate.

11. The portable washing station according to claim 10, wherein each of said secondary storage pockets has a fastener for closing the pocket.

12. The portable washing station according to claim 11, wherein said fastener comprises a zipper.

13. The portable washing station according to claim 1, wherein the means for draining fluids from the basin comprises:

a drain hose removably attached to said basin for draining fluids from said basin;

a drain plug removably attached to said basin for preventing the fluids from entering the drain hose; and means for releasably securing the drain hose to the support structure.

14. The portable washing station according to claim 13, further comprising another storage pocket disposed on said basin for storing said drain hose.

15. The portable washing station according to claim 1, further comprising a pair of side flaps integrally attached to the lower section of said mounting plate;

a bottom flap integrally attached to the upper section of said mounting plate; and means for releasably securing the side flaps and the bottom flap together in a folded position for storage and transport.

16. The portable washing station according to claim 15, further comprising:

at least one handle attached to at least one of said side flaps; and an identification tag secured to the at least one handle.

* * * * *